United States Patent [19]

Lesas et al.

[11] 4,204,054

[45] May 20, 1980

[54] PAPER STRUCTURES CONTAINING IMPROVED CROSS-LINKED CELLULOSE FIBERS

[75] Inventors: Claude H. Lesas, Colmar; Michel Pierre, Mulhouse, both of France

[73] Assignee: S. A. Beghin-Say, Thumeries, France

[21] Appl. No.: 940,188

[22] Filed: Sep. 7, 1978

Related U.S. Application Data

[63] Continuation-in-part of Ser. No. 731,895, Oct. 13, 1976, Pat. No. 4,113,936.

[30] Foreign Application Priority Data

Oct. 20, 1975 [FR] France ..... 75 31965
Aug. 1, 1978 [FR] France ..... 78 22657

[51] Int. Cl.[2] ..... D06M 13/14

[52] U.S. Cl. ..... 536/56; 8/116.4; 8/120; 162/142; 162/146

[58] Field of Search ..... 536/56; 8/116.4, 120; 162/146, 142

[56] References Cited

U.S. PATENT DOCUMENTS

| | | | |
|---|---|---|---|
| 1,816,973 | 8/1931 | Kantorowicz | 8/116.4 |
| 2,010,635 | 8/1935 | Kantorowicz | 162/72 |
| 2,311,080 | 2/1943 | Pinkney | 8/116.4 |
| 3,046,079 | 7/1962 | Reeves et al. | 8/116.4 |
| 3,224,926 | 12/1965 | Bernardin | 8/116.4 |
| 3,230,108 | 1/1966 | Marek | 8/116.4 |
| 3,264,054 | 8/1966 | Reinhardt et al. | 8/116.4 |
| 3,287,083 | 11/1966 | Hushebeck | 8/116.4 |
| 3,310,363 | 3/1967 | Russell et al. | 8/116.4 |
| 3,440,135 | 4/1969 | Chung | 8/116.3 |
| 3,700,549 | 10/1972 | Croon et al. | 8/120 |
| 4,035,147 | 7/1977 | Sangenis et al. | 8/116.4 |

OTHER PUBLICATIONS

Chemical Abstracts, vol. 82, No. 14, Apr. 7, 1975, p. 87968M.

*Primary Examiner*—Ronald W. Griffin
*Attorney, Agent, or Firm*—A. W. Breiner

[57] ABSTRACT

Fibrous structures in sheet form having from 10% to 90% by weight of pulp of cellulosic fibers cross-linked with formaldehyde, the predominant cross-linking being at the surface area of said fibers and in an amount sufficient to impart flexibility and softness to said fibers while retaining high water absorptivity, and 90% to 10% by weight of an additional binding product with the amount of the additional binding product being selected to ensure sufficient strength and cohesion to the structure of the sheet. The inclusion of the cellulosic fibers wherein the predominant amount of cross-linking is at the surface area of the fibers imparts excellent water absorptiveness to the fibrous structure and, in addition, provides good flexibility and touch and feel properties to the product.

23 Claims, No Drawings

PAPER STRUCTURES CONTAINING IMPROVED CROSS-LINKED CELLULOSE FIBERS

RELATED CASES

This application is a continuation-in-part of application Ser. No. 731,895 filed Oct. 13, 1976, now U.S. Pat. No. 4,113,936 issued on Sept. 12, 1978, entitled "Cross-Linking Of Cellulose Fibers In Gas Suspension"; and is related to application Ser. No. 940,189 filed Sept. 7, 1978 entitled "Improved Cross-Linked Cellulose Fibers," which in turn is a continuation-in-part of application Ser. No. 731,895.

FIELD OF AND STATEMENT OF INVENTION

The present invention relates to fibrous structures. More particularly, it is directed to cellulosic fibrous structures comprising, in combination, non-cross-linked cellulose fibers and cellulose fibers cross-linked with formaldehyde whereby the process of cross-linking requires an exposure of limited time duration of the cellulose fibers to the cross-linking reagent, thereby providing cross-linked cellulose fibers having unique characteristics.

Copending application Ser. No. 731,895 describes and claims a process for producing improved formaldehyde cross-linked cellulose fibers. Continuation-in-part application Ser. No. 940,189 filed Sept. 7, 1978 claims the improved cellulosic products. According to the process of application Ser. No. 731,895, cellulosic cross-linked fibers are prepared by depositing a reagent containing formaldehyde, hydrochloric acid and formic acid on individualized cellulose fibers and thereafter subjecting the fibers containing the deposited reagent to a heat-treatment in a system using hot air. The reaction time in the hot air is extremely short, i.e., from about 1 to 10 seconds. The temperature of the fibers during the heat-treatment does not reach more than about 50° C. in the hot air stream which is maintained at a temperature of from about 150° C. to 200° C. Accordingly, since there is no prolonged impregnation stage, or aging stage, the fibers are not damaged as a result of either the acidic nature of the cross-linking reagent or by the heat-treatment. However, as a result of the low fiber temperature and/or the limited duration of the treatment, the cross-linking apparently occurs primarily or predominantly at the surface of the cellulose fibers as opposed to the core of the cellulose fibers. Surprisingly, the fibers obtained by the cross-linking process have excellent flexibility and, additionally, good touch and feel properties. However, the water-absorption of the fibers continues to be excellent.

BACKGROUND OF INVENTION

It has been recognized in the prior art that cellulosic fibers which have been treated to provide cross-linking will no longer inter-link in an aqueous medium, i.e., undergo hydrogen or hydrate bonding. This is in contradistinction to the nature of non-cross-linked fibers which in an aqueous medium undergo cross-linking through hydrogen or hydrate bonding. Accordingly, heretofore cross-linked cellulosic fibers have been used primarily as fillers particularly for sanitary items such as diapers, napkins, tampons, medical dressing, etc., where an improvement in fluid absorptivity is desired, but wherein the need for improved strength, etc., obtained through inter-fiber bonding is not critical. Applications for cross-linked cellulosic fibers are described, for example, in U.S. Pat. No. 3,241,553.

Attempts have also been made according to other disclosures to use cross-linked cellulosic fibers to improve fibrous structures including through the utilization of non-cross-linked cellulosic fibers in combination with cross-linked fibers. Note, for example, French Pat. No. 1,235,963 which discloses the improvement of certain papers, such as filtering and absorbing papers. However, all of the examples relate to the utilization of cotton linters and not wood fibers. The described methods are inapplicable to wood fiber based compositions made by a wet process. Moreover, according to the process of the aforesaid French patent, the properties desired are an increase in porosity and absorption with a compromise in the uniformity of the formed sheet and, hence, its strength. There is no disclosure with respect to paper structures having increased flexibility and improved touch and feel characteristics.

French Pat. No. 1,600,269 discloses a manufacturing process for absorbing papers comprising the cross-linking of part of the fibrous material. Cross-linking takes place after the sheet has been passed over the Yankee drum, whereby the fibers are interlinked and the crepe nature of the paper, according to the described process, is maintained. The fibers are impregnated, then cross-linked, next washed to eliminate the catalyst, large amounts of water being used. An aging stage is required. Cross-linking during processing on the papermaking machine prohibits high industrial efficiency since a high-efficiency papermaking machine operating at about 1,000 meters a minute and a cross-linking phase lasting about 7 seconds would require a heating means over a length exceeding 100 meters.

U.S. Pat. No. 3,455,778 describes a process whereby cotton wool is made by the wet process using a mixture of cross-linked and non-crosslinked fibers. Urea-formol, which is expensive, is used as the cross-linking agent and the need for an impregnation stage prohibits making a low-cost paper. Furthermore, the wet grinding used in this process prohibits total fiber individualization, but on the contrary produces packs or "nodules" of cross-linked fibers "adhering" to each other, whereby machine operation is hampered and sheet formation is impeded, for example by clogging of the pumps by the nodules, etc. Additionally, the cross-linking process used does not provide sufficient output to feed a papermaking machine.

THE INVENTION IN DETAIL

According to the present invention, as stated hereinbefore, fibrous structures in sheet form can be prepared utilizing conventional paper-making machines wherein the fibrous compositions comprise individual cellulose fibers which have been cross-linked according to the process described in application Ser. No. 731,895 in combination with non-cross-linked fibers. The cross-linked fibers are merely mixed by any conventional means such as a pulper or other adequate equivalent with the cross-linked fibers and introduced into a header box or other supply means of a papermaking machine for subsequent application. The characteristics of the cross-linked fibers made in accordance with application Ser. No. 731,895 cellulosic fibers are sprayed with a composition as set forth in Table I and thereafter subjected to air treatment in accordance with the described process at a temperature of about 170° C. to provide cross-linked fiber hereinafter in Table I.

TABLE I

| Mixtures/Properties | Control | A | B | C | D |
|---|---|---|---|---|---|
| Composition in grams: | | | | | |
| 30% formol (g) | — | 360 | 360 | 360 | 1000 |
| 80% formic acid (g) | — | 100 | 100 | 100 | 140 |
| 36% hydrochloric acid (g) | — | 5 | 7.5 | 10 | 40 |
| water (g) | — | 640 | 640 | 640 | — |
| % fixed HCHO in the cellulose fibers (chromotropic acid analysis) | — | 1.0 | 1.3 | 1.4 | 2.2 |
| Pressed Samples: | | | | | |
| water absorption (g/g) | 4.2 | 11.4 | 16.8 | 23.5 | 27.2 |
| absorption after disintegration (g/g) | 4.0 | 10.6 | 14.0 | 11.6 | 27.0 |
| "feel" ($\mu$/g/m$^2$) | 4.0 | 4.5 | 10.4 | 14.4 | 25 |
| absorption speed (seconds) | 5 | 6 | 6 | 9 | 23 |
| sheet strength ($10^2$N) | | | | | |
| dry strength | >200 | 38 | 29 | 16 | 3 |
| wet strength | 16 | 36 | 35 | 24 | 5 |
| Unpressed Samples: | | | | | |
| water absorption (g/g) | 9 | 17 | 18.6 | 24 | 28 |
| "feel" ($\mu$/g/m$^2$) | 6.2 | 10.4 | 11.2 | 15.1 | 25 |
| absorption speed (time in seconds for 2 ml) | 6 | 6 | 6 | 12 | 28 |
| sheet strength ($10^2$N) | | | | | |
| dry strength | 77 | 18 | 22 | 13 | 3.5 |
| wet strength | 43 | 27 | 28 | 16 | 4 |

In Table I the measurements were carried out on small samples of 200 g/m$^2$ pressed at 2.5 bars and on patterns that were not pressed. The proportion of cross-linking agent fixed on the fibers is evaluated for each mixture using chromotropic acid analysis. The rate of capillary absorption has been measured using the test described by E. M. Buras, C. F. Goldthwait, and R. M. Kraemer in the "Text. Res. J.," April 1950, pp. 239–248, at a hydrostatic pressure of 4 cm. The sheet strength is measured by the force required for a ping-pong ball to cross at a speed of 400 mm/min a sheet fixed between two rings of 10 cm inside diameter. The strength in the wet or humid state is measured after having poured 10 ml water on the sheet by means of a pipette. After passing through 100,000 revolutions in the Lhomargy disintegrator, the quality of the treatment can be assessed for wet process use.

As apparent, the qualities of touch and feel, of absorption capacity and rate increase with the proportion of cross-linking. On the other hand, however, mechanical strength decreases considerably as cross-linking increases. It will be noted when comparing the sheet strength obtained for sheets B and C that there is a considerable variation even though the proportions of fixed formaldehyde are close to one another. This may be due to the lack of uniformity in atomizing, which would impair the accuracy of measurements made on small samples.

The fibrous structure offers significant advantages to prior art systems because of the use of fibers which have already been cross-linked. Accordingly, the properties of flexibility, softness, touch and feel and of absorption of the cross-linked fibers are essentially retained in the manufacturing process of the sheet on the papermaking machine, in contradistinction to the process described in French Pat. No. 1,600,269 noted above wherein some cohesion of the sheet is achieved before the cross-linking which fixes the crepe in the paper which adversely affects obtaining a paper of low density. Moreover, the cross-linked fibers used in accordance with the present invention are perfectly individualized, avoiding the drawbacks of other systems. As the percentage of cross-linked fibers in the fibrous structure increases, the properties of absorption and of the "feel" increase, however without loss of strength. Inversely, the strength rises with the percentage of non-cross-linked fibers, as shown in Table II, which lists the measurements for those properties for four different compositions of Vigor paper pulp, i.e., non-cross-linked pulp; and of cross-linked pulp per Example D of Table I. The measurements are performed on samples of 200 g/m$^2$ specific weight.

TABLE II

| Mixture | % of Cross-Linked Pulp | | | |
|---|---|---|---|---|
| "Vigor" paper pulp | 75 | 50 | 25 | — |
| Cross-linked pulp (Example D of Table I) | 25 | 50 | 75 | 100 |
| Pressed Samples: | | | | |
| absorption (g/g) | 8.0 | 12.6 | 16.2 | 27 |
| "feel" ($\mu$/g/m$^2$) | 6 | 8 | 12 | 25 |
| speed of absorption (sec.) | 8 | 8 | 10 | 22 |
| dry strength ($10^2$N) | 190 | 110 | 42 | 3 |
| wet strength ($10^2$N) | 35 | 35 | 40 | 5 |
| Unpressed Samples: | | | | |
| absorption (g/g) | 10.4 | 14.7 | 17.4 | 28 |
| "feel" ($\mu$g/m$^2$) | 8.2 | 10.5 | 13.4 | 25 |
| speed of absorption (sec.) | 8 | 9 | 10 | 28 |
| dry strength ($10^2$N) | 99 | 65 | 26 | 3.5 |
| wet strength ($10^2$N) | 35 | 33 | 32 | 4 |

The percentage of the selected cross-linked pulp is a compromise between the contradictory properties of the two components of the fibrous structure. It also depends on the cross-linkage proportion of the cross-linked pulp used.

Experiments establish that the percentage of the cross-linked pulp must be between 10 and 40% for the implemented fibrous structures noted above. Beyond 40% the strength of the absorbing sheet is inadequate for manufacture without binder on a papermaking machine, while below 10% no practical difference is observed with respect to a paper made without cross-linked pulp. The percentage of the cross-linked pulp can be increased for a lesser degree of cross-linking of the cross-linked pulp as would be expected. This applies to all the examples provided in the implementing embodiments of the invention. Preferably the percentage of the cross-linked pulp is between 15% and 30% of the fibrous structure. Experiments on the papermaking machine were carried out with a percentage of 20% of cross-linked pulp (see Example 1). In certain variations discussed hereinafter, the percentage of the cross-linked pulp may greatly exceed 40% provided reinforcement of the sheet is modified, for example by including a binder.

As a variation, a synthetic pulp can be substituted in part or in whole for the non-cross-linked paper pulp. The addition of the synthetic pulp to the cross-linked pulp also provides improvements in the mechanical properties while simultaneously offering the advantage of decreasing the "plushiness" of the obtained fibrous structure. The synthetic pulp acts as a consolidating agent through partial melting so as to introduce strength, in a manner known per se. Without such melting, the synthetic pulp would be a mere filler, unsuitable for increasing the strength and the cohesion of the fibrous structure. Such compositions provide sheets which are relatively flexible and which are only slightly "plushy." The percentage by weight of the synthetic pulp is selected within the range of 10% and 40% and preferably about 15%. The balance consisting of non-synthetic pulp are made up of cross-linked and non-cross-linked pulp in variable proportions depending on the emphasis on paper mechanical strength or absorption and feel and touch characteristics.

Table III lists the measurements of mechanical strength and of absorption which were obtained for a fibrous composition containing 20% of synthetic pulp (PEBD low-density polyethylene fibers, ref. B 5006, Elf Aquitaine) and wherein the percentage of the cross-linked pulp is made to vary, in accordance with the process of the main patent. The measurements are carried out on samples of 40 g/m$^2$ specific weight.

TABLE III

| % cross-linked fibers | 0 | 40 | 50 | 60 | 80 |
|---|---|---|---|---|---|
| rupture (× 100N) | 35 | 7 | 8 | 5 | 1.5 |
| capillary absorption (ml/g) | 5 | 12.1 | 13.5 | 13.6 | 17 |

Preferably a non-refined paper pulp, such as the Vigor pulp, noted hereinbefore, is used for the non-cross-linked pulp. Obviously it is known to make paper from a mixture of synthetic and cellulosic fibers, and even to reinforce paper by using a synthetic material in powder or film form (see, for instance, German Patent D.O.S. No. 2,615,889). Although such techniques are disclosed in a large number of documents, to the knowledge of applicants, mixtures of formaldehyde cross-linked cellulosic fibers and synthetic fibers have not been disclosed.

As previously indicated, other means for reinforcing the high-absorption sheet can be used, means which are more specifically related to improved flexibility, feel and touch characteristics of paper. Thus, according to another variation of the invention, the fibrous structure can be reinforced by incorporating a binder in the fibrous composition, which may be a mixture according to any of the viarations already cited.

Additional relevant art includes the process described in French Pat. No. 1,592,648 whereby substantially unrefined cross-linked cellulose fibers are used for manufacturing textiles, where said fibers are bonded amongst one another using a known binder according to the non-woven technology. In the aforesaid process, an epichlorohydrin cross-linked pulp is used. This process also involves an expensive product. Further, the process is slow because of the need to heat and the necessity to wash in basic media. The cross-linking stage requires several minutes. The process does not relate to the manufacture of paper sheets having the essential characteristics of softness, flexibility, and good feel and touch on a high output papermaking machine. The incorporated binder, represented as a percentage in weight, can be as high as 40%, preferably between 3 and 20% by weight of the fibrous structure, and preferably is an acrylic latex.

The results of a laboratory study set forth as Table IV herein establish that without loss in thickness but with a gain in length, the strength of a fibrous sheet can be substantially doubled by incorporating 5% of acrylic latex into the material.

TABLE IV

| | Control Sample With 30% of Cross-Linked Pulp | Control + 2.5% of P339 Latex | Control + 5% of P339 Latex | Control + 10% of P339 Latex |
|---|---|---|---|---|
| *SR (degree Schopper) | 13 | 12 | 15 | 16 |
| Surface sp. weight (g/m$^2$) | 100 | 92 | 102 | 101 |
| Thickness in mm | 0.236 | 0.213 | 0.233 | 0.214 |
| Muellen Index | 5.8 | 9.36 | 10.88 | 14.16 |
| Muellen (bars) | 0.58 | 0.86 | 1.11 | 1.43 |
| Rupture load, direction of advance, 10$^2$N | 57 | 93 | 111 | 130 |
| Elongation % | 1.5 | 2.5 | 3.5 | 4.2 |
| Tear (10$^{-2}$N) with leader | 48 | 93 | 108 | 110 |

As a further variation, the reinforcement of the absorbing sheet can be implemented by binder printing. Binder printing is a known technique, presently in use, for non-woven materials. Numerous patents disclose the aforesaid technique, for instance French Pat. Nos. 462,983; 2,143,424; 2,227,369; 2,235,221; 2,269,606, and 2,250,853; as well as British Pat. Nos. 1,170,817 and 1,244,755 which relate to manufacturing cigarette paper. However, there is no disclosure of a fibrous structure of a composition which comprise cellulosic fibers previously cross-linked and made into sheets using the wet process in combination with non-cross-linked paper fibers and/or with synthetic fibers. Moreover, in the references, there is no compression of the fiber containing sheets wherein the water is evacuated by conventional means. The described processes require a special machine, as described in the patents.

In contradistinction, machine experiments were carried out according to this invention using a mixture of cross-linked cellulosic fibers and non-cross-linked cellulosic fibers reinforced by binder printing as developed in Example 2, hereinafter.

Other modes of implementation of the invention are feasible by combining several reinforcing means. Thus, a mixture of cross-linked cellulosic fibers and of non-cross-linked fibers may be used with reinforcement both by incorporating the binder into the material and by printing it. Again the reinforcement may be achieved by printing a mixture of cross-linked cellulosic fibers and synthetic fibers. Table V lists the spread of the percentage (in percent by weight of the mixture) of cross-linked cellulosic fibers for each variation of the invention, when using the wet process, for a sheet with a specific weight less than 40 g/m². In Table V, F=cellulosic fibers cross-linked according to the method of application Serial No. 731,895;

P=non-cross-linked cellulosic fibers; and

S=synthetic fibers.

The percentage of cross-linked cellulosic fibers depends on the degree of cross-linking of the fibers. As regards the examples of Tables V and VI, the proportion of fixed formaldehyde in the selected cross-linked fibers varies from 1.3% to 2.1% for those mixtures including non-crosslinked cellulosic fibers P. The proportion of fixed formaldehyde in the ranges F+S is between 0.6% and 2.6%.

TABLE V

| Mixtures | In Weight Of Cross-Linked Pulp | | |
|---|---|---|---|
| | Large Range | Preferred Range | Optimal Percentage |
| F − P | 10-50 | 15-30 | 20 |
| F − P + dry latex print | 10-50 (1-20) | 15-30 (3-20) | 20 (3) |
| F − P + latex in material | 10-50 (5-35) | 15-30 (5-25) | 20 (15) |
| F − S | 50-90 | 65-90 | 80 |

Similarly, Table VI lists the percentages (by weight of the mixture) of the cross-linked cellulosic fibers for each variation of the invention, but in this instance as obtained by the wet process of a sheet with a specific weight between 40 and 100 g/m².

TABLE VI

| Mixtures | % In Weight Of Cross-Linked Pulp | | |
|---|---|---|---|
| | Large Range | Preferred Range | Optimal Percentage |
| F − P | 10-70 | 15-40 | 25 |
| F − P + dry latex printing | 10-70 2-40 | 15-30 3-20 | 30 10 |
| F − P + latex in material | 10-70 (5-40) | 15-40 (10-35) | 30 (20) |
| F − S | 50-90 | 60-85 | 70 |

As indicated hereinbefore, the cross-linked pulp can be combined with a mixture of synthetic pulp and non-cross-linked cellulosic pulp. Laboratory tests have shown that the percentage by weight of cross-linked cellulosic fibers must be selected between 20 and 40%, preferably near 30%; and that the percentage by weight of non-cross-linked fibers must be selected between 30 and 70%, preferably near 55%; whereas the percentage by weight of synthetic fibers must be selected between 10 and 30%, preferably near 15%.

As hereinbefore stated and in all the examples of the preferred embodiments of the invention, the percentage of the cross-linked fiber pulp can be increased if the fibers are cross-linked to a lesser degree.

The experiments as follows were carried out on commercial papermaking machines.

Example 1:

Fiber Composition—Ordinary Paper Fiber and Cross-Linked Fibers According to Ser. No. 731,895

The composition used was

64% of non-refined conifer fibers;

16% of non-refined sheet fibers; and

20% of fibers cross-linked according to the method of application Ser. No. 731,895, the proportion of cross-linking being substantially as set forth in Example C in Table I. The fibers are mixed in the stock chest and are moved to the wire gauze of a Voith cotton machine rotating at 800 meters a minute and producing 5,500 kg of creped cotton an hour. The properties obtained are different from those of an ordinary resultant paper as shown in Table VII.

TABLE VII

| | Control | Sample From Machine Output |
|---|---|---|
| Specific weight, g/m² | 28 | 28.5 |
| Thickness, 10 folds in mm | 1.28 | 2.40 |
| Rupture load in sense of advance, grams | 334 | 114 |
| Elongation % | 17 | 23.5 |
| Transverse rupture load in grams | 130 | 70 |
| Rigidity in jules, $\times 10^{-3}$ | 6.6 | 4.9 |

Example 2:

Fibrous Composition-Ordinary Paper Fibers+Cross-Linked Cellulosic Fibers+Printed Latex Fibers The paper made according to Example 1 was reinforced by printing. To that end a hexagonal, deformed sample was used, with the greatest length parallel to the direction of advance of the machine. The latex covered surface represents 21% of the sheet, the deposition being about 0.4 g/m²-second of Swift latex ref. 46,668.

TABLE VIII

| | Control | Partially Decreped Cotton Printed At 175 m/min |
|---|---|---|
| Specific weight, g/m² | 31 | 30 |
| Thickness, 10 folds in mm | 2.2 | 1.75 |
| Rupture load in sense of advance, grams | 150 | 290 |
| Elongation % | 16.5 | 13 |
| Transverse rupture load in grams | 50 | 70 |
| Rigidity in jules, $\times 10^{-3}$ | 5.5 | 6.8 |

The prints were performed on a cotton wool slightly heavier than that of Example 1, which explains the thickness of 2.2 mm and not of 2.4 mm. The printing process is photogravure.

Example 3:

Fibrous Composition-Ordinary Paper Fibers+Cross-Linked Fibers+Latex Incorporated Into The Material The composition used is as follows:

68% of non-refined conifer fibers;

17% of non-refined sheet fibers; and

15% of cross-linked fibers obtained by the method of application Ser. No. 731,895.

The fiber mixture is obtained in a stock chest to which is added 5% by weight of the Rohm & Haas P339 latex mixture. 0.6% of Hercules-Powder, 557 HV Kymene is added to precipitate the latex on the fibers and this mixture is then fed to horizontal, flat-bank machine operating at 100 m/min.

TABLE IX

| | Control, With 0.6% Kymene, No Latex | With 5% Latex |
|---|---|---|
| Specific Weight, g/m$^2$ | 26 | 25.6 |
| Thickness, 10 folds in mm | 2.03 | 2.05 |
| Rupture load in sense of advance, grams | 60 | 180 |
| Elongation % | 11 | 13.5 |
| Transverse rupture load in grams | 50 | 90 |
| Rigidity in jules, $\times 10^{-3}$ | 5.2 | 7.4 |

The present invention also applies to a method for obtaining fibrous structures in sheets of any of the above-described compositions. The process is characterized in that these compositions allow making the sheet on a conventional papermaking machine. More particularly, in the case of a sheet reinforced by printing a binder, the process is characterized by the two following stages considered in combination: a continuous sheet is made by using a papermaking machine in a manner known per se; and a binder is printed on the sheet that was made at a speed essentially equal to that with which it leaves the papermaking machine, with the speed of the machine being between 500 and 1,000 meters a minute.

It is claimed:

1. Fibrous structure in sheet form having the composition as follows:

10% to 90% by weight of pulp consisting essentially of cellulosic fibers cross-linked with formaldehyde, the predominant cross-linking being at the surface area of said fibers and in an amount sufficient to impart flexibility and softness to said fibers; and 90% to 10% by weight of an additional binding product, said amount being selected to ensure sufficient strength and cohesion to the structure of said sheet.

2. The fibrous structure according to claim 1 wherein the formaldehyde cross-linked cellulosic fibers are obtained by the spraying of a cross-linking reagent of formaldehyde as a mixture with hydrochloric acid and formic acid on individualized cellulose fibers; immediately after said spraying introducing said fibers which have said cross-linking reagent uniformly disposed thereon into an air stream having a temperature of from about 60° to 250° C. and a velocity of from about 1 to 20 m/sec during a curing time period ranging between from about 1 and 20 seconds to effect a cross-linking reaction, and separating the fibers from said air stream.

3. Fibrous structure according to claim 2 wherein said additional binding product consists essentially of non-cross-linked cellulosic fibers.

4. Fibrous structure according to claim 3 in the form of a sheet of a specific surface weight less than 40 g/m$^2$ and wherein 15% to 30% by weight of a pulp of said cross-linked cellulosic fibers were obtained by said process wherein the proportion of formaldehyde to said fibers on a weight basis is between 1.3 and 2.1%; and 85% to 70% by weight of a pulp of non-cross-linked cellulosic fiber selected from the group consisting of bisulfite pulp, a "Kraft" pulp, a pulp of deciduous growths, or a mixture thereof.

5. Fibrous structure according to claim 4 wherein said composition includes 20% by weight of a pulp of said cross-linked cellulosic fibers.

6. Fibrous structure according to claim 2 in the form of a sheet with a specific surface weight between 40 and 100 g/m$^2$, and wherein 15% to 40% by weight of a pulp of said cross-linked cellulosic fibers were obtained by said process, wherein the proportion of formaldehyde to said fibers on a weight basis is between 1.3 and 2.1%; and 85% to 60% by weight of a pulp of non-cross-linked cellulosic fibers selected from the group consisting of bisulfite pulp fibers, a "Kraft" pulp fiber, and deciduous growths pulp fibers, or a mixture thereof.

7. Fibrous structure according to claim 6 wherein said composition includes 25% by weight of a pulp of said cross-linked cellulosic fibers.

8. Fibrous structure according to claim 2 wherein the additional binding product includes synthetic fibers.

9. Fibrous structure according to claim 8 wherein said composition comprises 65% to 85% by weight of a pulp of said cross-linked cellulosic fibers, the proportion of formaldehyde to said fibers on a weight basis being between 0.6 and 2.6%; and 35% to 15% of synthetic pulp fibers.

10. Fibrous structure according to claim 9 wherein said synthetic fibers are low-density polyethylene fibers.

11. Fibrous structure according to claim 2 wherein the additional binding product includes a mixture of non-cross-linked cellulosic fibers and of synthetic fibers.

12. Fibrous structure according to claim 11 wherein said composition includes 20% to 40% by weight of a pulp of said cross-linked cellulosic fibers, the proportion of formaldehyde to said fibers on a weight basis being between 1.3 and 2.1%; 30% to 70% by weight of a pulp of non-cross-linked cellulosic fibers; and 10% to 30% by weight of synthetic fibers.

13. Fibrous structure according to claim 12 wherein said composition includes 30% by weight of a pulp of said cross-linked cellulosic fibers, the proportion of formaldehyde to said fibers on a weight basis being between 1.3% and 2.1%; 55% by weight of a pulp of non-cross-linked cellulosic fibers; and 15% by weight of a pulp of synthetic fibers.

14. Fibrous structure according to claim 2 wherein the additional binding product includes a binder printed on the surface of the sheet.

15. Fibrous structure according to claim 14 wherein the printed binder is photogravure consisting of a deformed hexagonal pattern of which the greatest length is parallel to the transverse direction of the machine, and the binder is a latex.

16. Fibrous structure according to claim 15 in the form of a sheet of specific surface weight less than 40 g/m$^2$ wherein the percentage in weight of the binder in the structure is between 3 and 20%.

17. Fibrous structure according to claim 15 in the form of a sheet of specific surface weight between 40 g/m$^2$ and 100 g/m$^2$ wherein the percentage of binder in the structure is between 3 and 20%.

18. Fibrous structure according to claim 2 wherein the additional binding product includes a binder incorporated into the material.

19. Fibrous structure according to claim 18 in the form of a sheet with a specific surface density less than 40 g/m$^2$ wherein the percentage in weight of the binder in the structure is between 5 and 25%.

20. Fibrous structure according to claim 18 in the form of a sheet with a specific surface weight between 40 g/m$^2$ and 100 g/m$^2$ wherein the percentage in weight of the binder in the structure is between 10 and 35%.

21. Fibrous structure according to claim 18 wherein the binder incorporated into the material is an acrylic latex.

22. A process for making fibrous structures with compositions defined in claim 14 characterized by the following stages in combination: forming a continuous sheet on a papermaking machine; and printing a binder on the sheet at a speed essentially equal to the speed of the sheet at the machine's output.

23. A process for making fibrous structures according to claim 22 wherein the speed of the papermaking machine is between 500 and 1,000 meters a minute.

* * * * *